US009976330B2

(12) United States Patent
Roels

(10) Patent No.: US 9,976,330 B2
(45) Date of Patent: May 22, 2018

(54) DAMPENING A HINGED COMPONENT

(71) Applicant: Hewlett-Packard Development Company, L.P., Houston, TX (US)

(72) Inventor: Timothy J. Roels, Vancouver, WA (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 0 days. days.

(21) Appl. No.: 15/290,950

(22) Filed: Oct. 11, 2016

(65) Prior Publication Data

US 2018/0100340 A1 Apr. 12, 2018

(51) Int. Cl.

| | |
|---|---|
| ***B41J 2/00*** | (2006.01) |
| ***E05F 7/06*** | (2006.01) |
| ***G03G 21/16*** | (2006.01) |

(52) U.S. Cl.

CPC ..... *E05F 7/06* (2013.01); *G03G 21/1633* (2013.01); *E05Y 2900/606* (2013.01)

(58) Field of Classification Search

None

See application file for complete search history.

(56) References Cited

U.S. PATENT DOCUMENTS

| | | | | |
|---|---|---|---|---|
| 6,129,348 | A | 10/2000 | Park | |
| 6,604,307 | B1 * | 8/2003 | Cahill | B65D 3/22 40/306 |
| 7,073,787 | B2 | 7/2006 | Kinsley et al. | |
| 8,177,445 | B2 | 5/2012 | Jones et al. | |
| 8,358,954 | B2 | 1/2013 | Tanaka | |
| 8,833,759 | B2 | 9/2014 | Fan Chiang et al. | |
| 2004/0218952 | A1 | 11/2004 | Teo et al. | |
| 2011/0193927 | A1 * | 8/2011 | Matsushima | B41J 2/32 347/218 |

OTHER PUBLICATIONS

Tray 1/MP Tray damper, < http://www.partshere.com/online/detail.asp?partno=RC1-1038-000CN >, download date Oct. 11, 2016.

* cited by examiner

*Primary Examiner* — Matthew Luu
*Assistant Examiner* — Tracey McMillion
(74) *Attorney, Agent, or Firm* — Mannava & Kang, P.C.

(57) ABSTRACT

According to an example a dampening system for a hinged component may include a spring having a first end hooked onto a chassis and a second end hooked onto to a strap, in which the strap is connected to the hinged component. The dampening system may also include a curved guide element attached to the chassis, in which the spring is to bend around a portion of the curved guide element as the strap is moved from a first position to a second position.

12 Claims, 3 Drawing Sheets

DAMPENING A HINGED COMPONENT

BACKGROUND

Office products, such as multi-function devices, often feature a multipurpose tray or bypass tray that sits in a vertically folded position when closed and sits in a lowered, typically slightly angled position when opened. In the vertically folded position, the multipurpose trays typically function to cover input slots of the multi-function devices through which media, such as paper, may be inserted into the multi-function devices. In the opened position, the multipurpose trays typically function to support media that is to be fed into the input slots of the multi-function devices such that the media may receive marking material, such as ink or toner.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
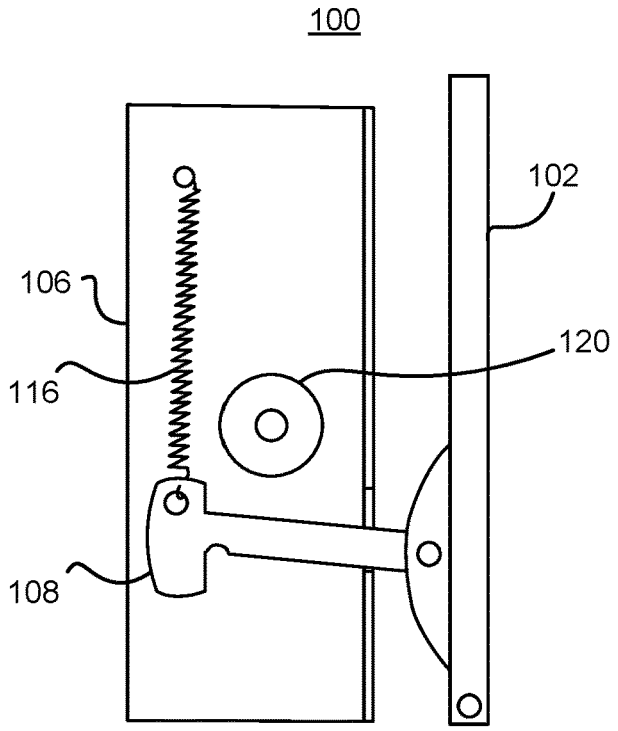
FIGS. 1-4, respectively show simplified block diagrams of an example dampening system.

Disclosed herein are a dampening system for dampening the effects of gravity on the lowering of a hinged component from a first position to a second position and an apparatus that contains the dampening system. That is, the dampening system may decrease the rate at which a hinged component, such as a multipurpose tray, a bypass tray, or the like, may be rotated from a first, vertical, position to a second position that is angled with respect to the first position. Particularly, the dampening system may include a spring and a curved guide element that may cause the spring to apply an increasing amount of force (e.g., tension) onto the hinged component as the angle between the hinged component and a vertical axis increases. In one regard, the dampening system disclosed herein may prevent the hinged component from falling at a rapid rate and may thus prevent the generation of an acoustic noise when the hinged component reaches its lowest point.

Through implementation of the dampening system disclosed herein, apparatuses, such as inkjet printing devices, laser printing devices, 3D printing devices, multifunction devices, etc., may be manufactured with relatively thicker, and thus heavier and stiffer, hinged components, e.g., multipurpose trays, bypass trays, etc. That is, the use of the dampening system disclosed herein may enable the use of the thicker hinged components without substantial risk of the hinged components falling at rapid rates, bouncing as they reach their lowest points, and causing relatively loud acoustic noises. As used herein, the terms "a" and "an" are intended to denote at least one of a particular element, the term "includes" means includes but not limited to, the term "including" means including but not limited to, and the term "based on" means based at least in part on.

With reference to FIGS. 1-4, there are respectively shown simplified block diagrams of an example dampening system 100 for a hinged component 102. It should be understood that the dampening system 100 depicted in FIGS. 1-4 may include additional components and that some of the components described herein may be removed and/or modified without departing from a scope of the dampening system 100 disclosed herein.

Generally speaking, the dampening system 100 may form part of an electronic device, such as a printer, a scanner, a multifunction device, or the like. A multifunction device may be a device that may perform printing, scanning, and/or faxing operations. For instance, the hinged component 102 may be hinged to the electronic device at a hinge 104. That is, the hinged component 102 may have a relatively planar configuration and may be rotatably attached to a chassis 106 or an outer cover (not shown) of the electronic device by a single hinge 104 or by multiple hinges 104. The chassis 106 may be formed of a metallic, a plastic, a composite, or the like, material, and may provide structural support to the electronic device. In other examples, the chassis 106 may be part of an outer covering or casing of the electronic device or may be the outer covering of the electronic device. The hinge 104 may include a pin formed of a metal, plastic, or composite material that is inserted into openings in the hinged component 102 and the electronic device.

According to an example and as shown and described with respect to FIGS. 5 and 6 below, the dampening system 100 may be installed as part of a multipurpose tray (or equivalently, a bypass tray, a hinged tray, etc.) in an electronic device, such as a printer, a multifunction device, or the like. That is, the hinged component 102 may be a multipurpose tray on which media, such as paper, may be positioned to be fed into the electronic device. The hinged component 102 may be formed of relatively stiff materials, such as plastic, metal, or a combination thereof.

Figure 2:
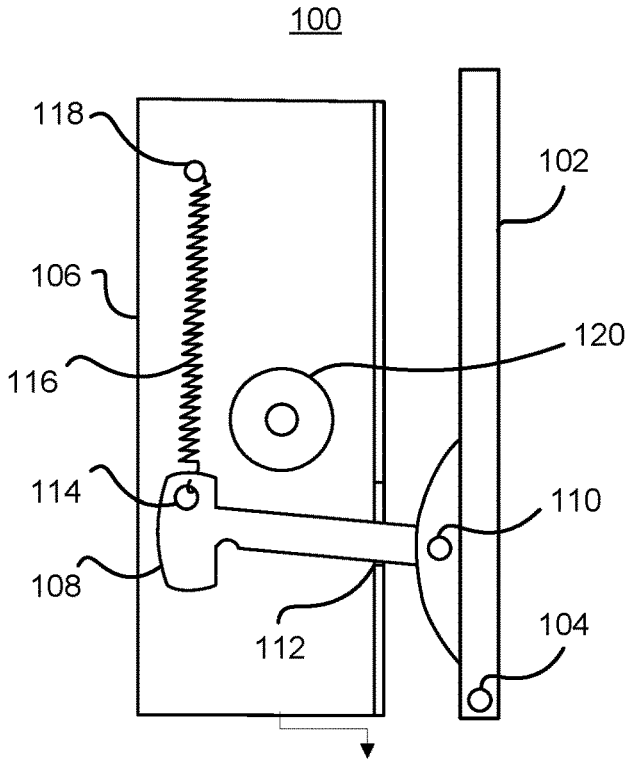

In FIGS. 1 and 2, the hinged component 102 is depicted as being in a first position in which the hinged component 102 extends vertically. In the first position, the hinged component 102 may block access to an input slot (shown in FIG. 6) of the electronic device through which media may be fed to printing components 130 (FIG. 4) of the electronic device. In this regard, the input slot may be in a media feed 132 path to the printing components 130. The printing components 130 may represent any mechanical, electrical, or electromechanical part of the electronic device that may be implemented to direct media to receive marking materials. For instance, the printing components 130 may represent any of printheads, toner cartridges, rollers, image sensors, and the like.

The dampening system 100 may also include a strap 108 that is pivotally connected to the hinged component 102 at a connection 110, which may also be a hinged connection. The connection 110 may also include a pin inserted into openings on the strap 108 and the hinged component 102. The strap 108 may extend through a slot 112 formed in the chassis 106 such that one portion of the strap 108 is one side of the chassis 106 and another portion of the strap 108 is on the opposite side of the chassis 106. The strap 108 may also a section having a relatively larger section in which an opening 114 may have been formed. The opening 114 may be positioned near an opposing end of the strap 108 with respect to the connection 110. As shown, the opening 114 may support a first end of a spring 116 and a second end of the spring 116 may be supported by a post 118 extending from a wall of the chassis 106. That is, the first end of the spring 116 may be hooked onto the strap 108 at the opening 114 and the second end of the spring 116 may be hooked onto the post 118 extending from the chassis 106 (or equivalently, a wall of the chassis 106). In other examples, the opening 114 may be replaced by a post or other component and/or the post 118 may be replaced by an opening or other component that enables the spring 116 to be hooked onto the chassis 106 and the strap 108.

Figure 4:
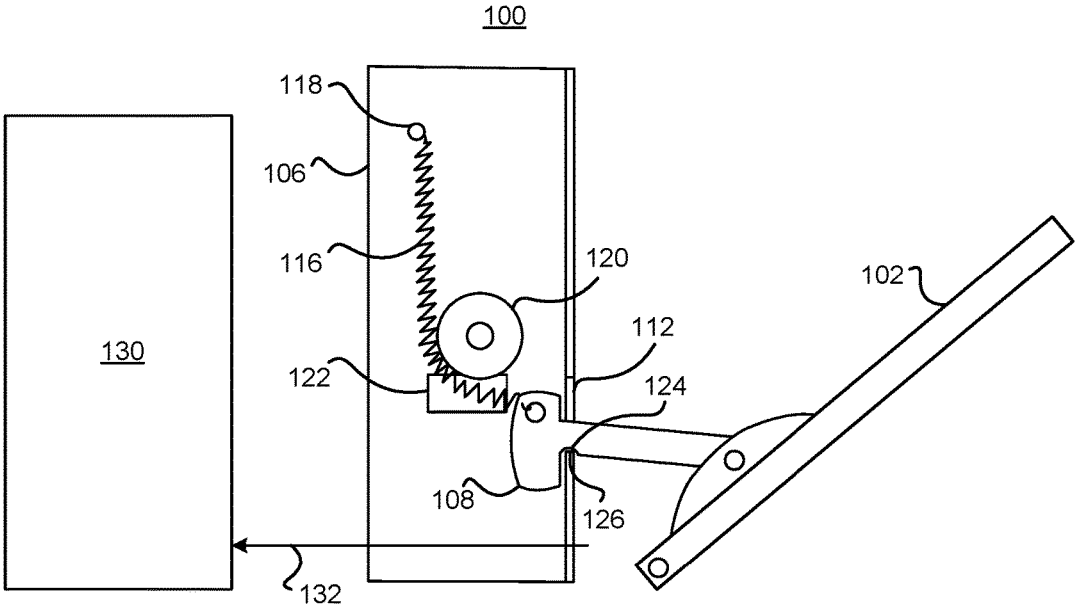

According to an example, the spring 116 may dampen the effects of gravity on the lowering of the hinged component 102 from the vertical position shown in FIGS. 1 and 2 to the lowered position shown in FIG. 4. That is, the spring 116 apply a force that compensates for the application of force by gravity onto the hinged component 102 as the hinged component 102 is rotated from the vertical position (first angle) shown in FIGS. 1 and 2 to a second position (which may also be a second angle, second position, an open position, etc.) about the hinge 104, for instance, as shown in FIG. 4. For instance, the spring 116 may support part of the weight of the hinged component 102 as the hinged component 102 is rotated away from the chassis 106 such that the hinged component 102 does not drop suddenly. In other words, the spring 116 may partially support the hinged component 102 such that the hinged component 102 is dropped at a specified rate. The specified rate may be a rate that is sufficiently slow to prevent the hinged component 102 from bouncing and making a banging noise when moved to a fully open position while also allowing the hinged component 102 to move to a second position as shown in FIG. 4 under the force of gravity.

According to examples, the spring 116 may be formed of metal or other suitable material and may have a spring constant that is sufficient to compensate for the majority of the weight of the hinged component 102. In these examples, the spring 116 may be selected based upon the type and/or weight of the hinged component 102. That is, the selected sprint 116 may have a spring constant that enables the hinged component 102 to be dropped at a specified rate.

Figure 3:
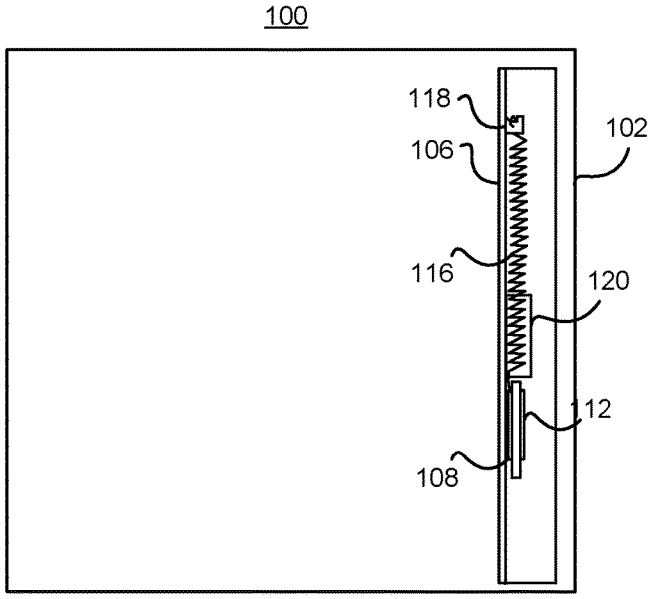

As shown in FIGS. 1, 2, and 3, as the hinged component 102 is rotated away from the chassis 106, the spring 116 may contact a curved guide element 120. The curved guide element 120 may be attached to the chassis 106 via a mechanical fastener and/or adhesive. The curved guide element 120 may be formed of a metallic, a plastic, a nylon, a composite, or the like material. As shown, the curved guide element 120 may be located at a position to cause the spring 116 to bend around a portion of the curved guide element 120 as the hinged component 102 is lowered into the second position (FIG. 4) and the spring 116 is expanded. For instance, the curved guide element 120 may be positioned between the end of the spring 116 that is hooked onto the chassis 106 and the strap 108. In one regard, the bending of the spring 116 around a portion of the curved guide element 120 may change the angle of the spring 116 as the strap 108 is moved through the slot 112.

As the hinged component 102 opens, the curved guide element 120 may cause the tension in the spring 116 to increase to compensate for the increased moment caused by gravity on the hinged component 102 as the angle between the hinged component 102 and the chassis 106 increases. For instance, without the curved guide element 120, the tension applied onto the strap 108 by the spring 116 may be reduced and may change at a different rate, which may result in the hinged component 102 falling at a faster rate than desired and/or at an uneven rate.

Turning now to FIG. 3, there is shown a side view of the dampening system 100 shown in FIGS. 1 and 2. As shown, the spring 116, the strap 108, and the curved guide element 120 may be positioned substantially along a common plane, e.g., are substantially collinear with respect to each other. In this regard, as the strap 108 is moved along a first plane with the rotation of the hinged component 102, the spring 116 may also extend along the first plane or in a parallel plane and contact the curved guide element 120.

In addition, portions of the spring 116 may contact the chassis 106 and may cause the spring 116 and the strap 108 to vibrate, which may result in the generation of an acoustic sound as the hinged component 102 is lowered. To reduce the vibration caused by friction between the spring 116 and the chassis 106, a label 122 may be positioned between a portion of the spring 116 and the chassis 106, for instance, as shown in FIG. 4. The label 122 may have a lower coefficient of friction than a wall of the chassis 106. In this regard, the label 122 may function as an insulator/insulator that prevents or reduces the acoustic sound caused through moving contact between the spring 116 and the wall of the chassis 106. By way of example, the label 122 may be formed of plastic and may be adhered to the wall of the chassis 106.

As also shown in FIG. 4, the strap 108 may include a notch 124 formed along a bottom surface of the strap 108. The notch 124 may contact a stop tab 126 formed in the slot 112 of the chassis 106 through which the strap 108 extends. Contact between the notch 124 and the stop tab 126 may maintain the hinged component 102 at the second position shown in FIG. 4. According to an example, the spring 116 and the curved guide element 120 are positioned with respect to the strap 108 such that the spring 116 may apply force onto the strap to facilitate contact between the notch 124 and the stop tab 126 when the strap 108 is in the position shown in FIG. 4. In addition or as another example, the hinged component 102 may be supported in the second angle shown in FIG. 4 solely by the spring 116 and the strap 108.

As shown in FIGS. 1-4, the spring 116 may be removed from either or both of the opening 114 and the post 118 to enable the hinged component 102 to be removed. In this regard, the hinged component 102 may be relatively easily removed and inserted into an electronic device.

According to some examples, the strap 108, the spring 116, the post 118, and the curved guide element 120 are provided on one side of the hinged component 102 as shown in FIG. 3. However, in other examples, although not shown, a second strap, a second spring, a second post, and a second curved guide element may be provided on an opposite side of the hinged component 102. That is, for instance, the second strap may be hingedly connected to the hinged component 102 at a location distal from the connection 110. The second spring may be supported by the second strap and may also be supported in a second hole in the chassis 106. An example of a second strap positioned distally from the strap 108 is depicted in FIG. 6.

Figure 5:
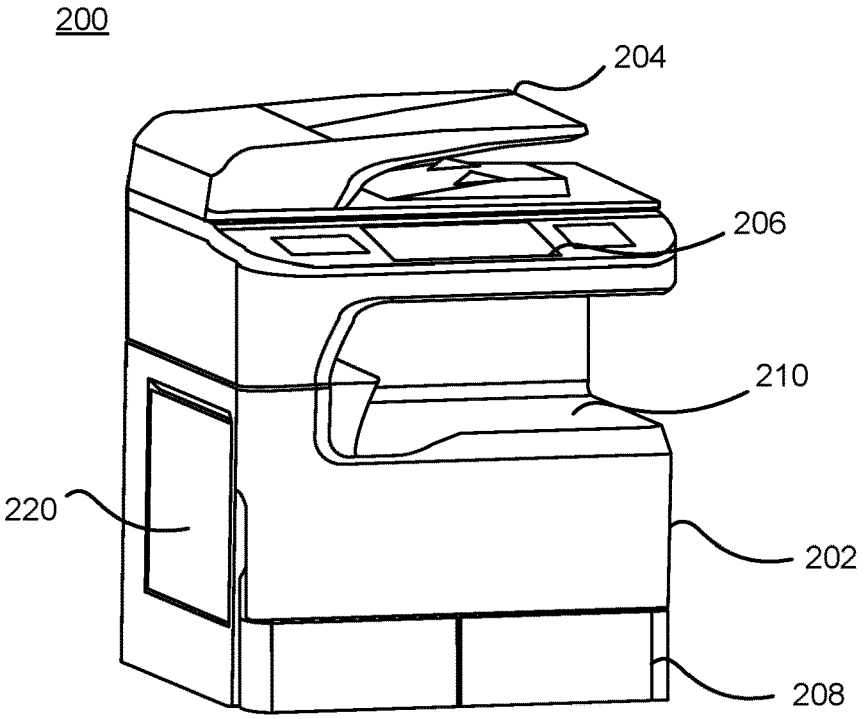
FIGS. 5 and 6, respectively, depict perspective views of an example apparatus containing components of the dampening system depicted in FIGS. 1-4.
Figure 6:
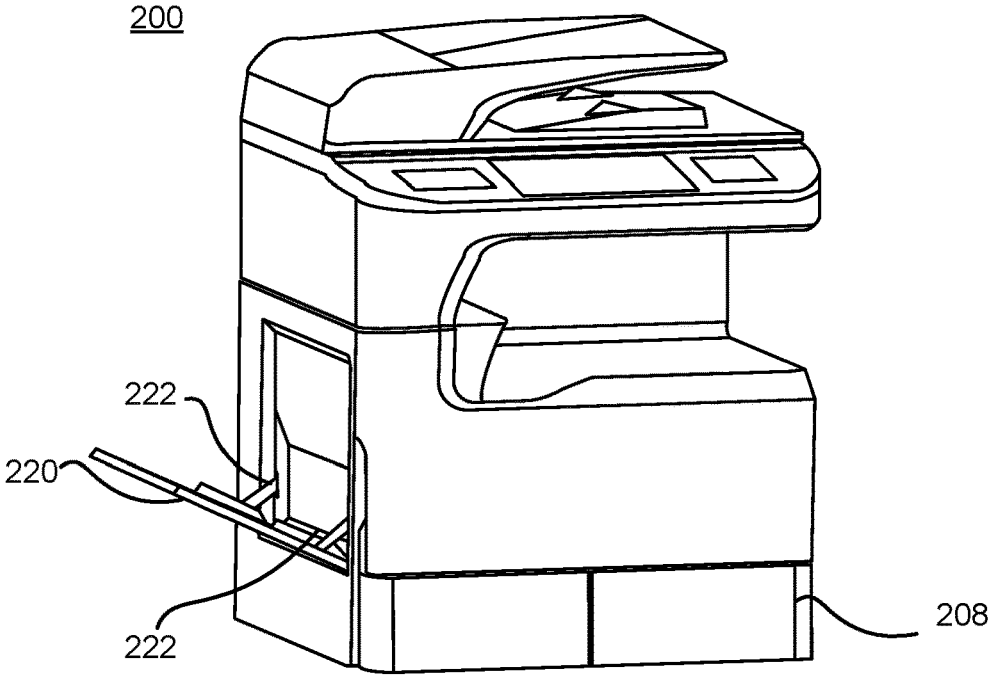

With reference now to FIGS. 5 and 6, there are respectively shown perspective views of an example apparatus 200 containing components of the dampening system 100 depicted in FIGS. 1-4. The apparatus 200 may be a printing apparatus, such as a laser printer, an inkjet printer, a 3D printer, or the like. The apparatus 200 may also be a multifunction device that may include the functionality of a printing apparatus, e.g., the apparatus 200 may perform printing operations, scanning operations, etc. As shown, the apparatus 200 may include an outer casing 202, a document feeder 204, a control panel 206, media trays 208, as well as various other elements.

Although not shown, the apparatus 200 may also include a chassis and printing components 130 housed inside the outer cover 202 and the chassis. The printing components 130 may include various components for applying marking material (e.g., ink, toner, etc.) onto media, mechanical devices for moving the media through the printing components 130, a heating device for drying the marking material, etc. The printing components 130 may be positioned in and/or may form printing paths through the apparatus 200. For instance, a printing path 132 may originate from a location near the media trays 208, past the components for applying marking material, and to an output tray 210.

The apparatus 200 may also include a tray 220, which may be equivalent to the hinged component 102 depicted in FIGS. 1-4. As such, the tray 220 may be a multipurpose tray, a bypass tray, a hinged tray, etc., and the tray 220 may be part of a dampening system. In this regard, the tray 220 may be hingedly connected to a strap 222 as shown in FIG. 6, which may be equivalent to the strap 108 depicted in FIGS. 1-4. In addition, one end of a spring 116 may be removably supported by (e.g., hooked onto) the strap 108 and the other end of the spring 116 may be removably supported by (e.g., hooked onto) the chassis 106 of the apparatus 200. Moreover, a curved guide element 120 may be mounted to the chassis 106 between the post 118 and the strap 108 as shown in FIGS. 1-4. In other words, during movement of the tray 220 in the apparatus 200 from the closed position shown in FIG. 5 to the open position shown in FIG. 6, the dampening system may cause the tray 220 to be moved at a specified rate as discussed above with respect to FIGS. 1-4. In some examples, the apparatus 200 may include one dampening system and in other examples, the apparatus 200 may include two dampening systems as discussed above with respect to FIGS. 1-4.

When the tray 220 is in the open position, an input slot 222 may be accessible. The input slot 222 may be part of another printing path 132 through and/or formed by the printing components 130. Thus, for instance, the tray 220 may be employed to supply media for printing while bypassing the media in the media trays 208.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A dampening system for a hinged component, said dampening system comprising:

a spring having a first end hooked onto a chassis and a second end hooked onto a strap, the strap connected to the hinged component;

a curved guide element attached to the chassis, the spring to bend around a portion of the curved guide element as the strap is moved from a first position to a second position; and a stop tab disposed on a wall of the chassis, the wall defining an opening through which the strap extends, and a notch of the strap that is to contact to the stop tab, wherein the spring and the curved guide element are to apply a force onto the strap to facilitate contact between the notch and the stop tab when the strap is in the second position.

2. The dampening system according to claim 1, wherein the strap moves along a first plane and wherein the spring extends along the first plane.

3. The dampening system according to claim 1, wherein the curved guide element is positioned between the first end of the spring and the strap.

4. The dampening system according to claim 1, wherein the spring has a spring constant that is sufficient to enable the hinged component to be moved from the first angle to the second angle at a specified rate.

5. The dampening system according to claim 1, further comprising:

a second spring attached to a second strap, wherein the second strap is hooked onto the hinged component; and a second curved guide element attached to the chassis, wherein the second spring is to bend around the second curved guide element as the second strap is moved from a first position to a second position, wherein the first position corresponds to the hinged component being at the first angle and the second position corresponds to the hinged component being at the second angle.

6. The dampening system according to claim 1, wherein the hinged component is a tray of a printing device.

7. The dampening system according to claim 1, further comprising:

a label provided on a wall of the chassis at a location at which the spring is to contact the wall, wherein the label has a lower coefficient of friction as compared with the wall.

8. A printing apparatus comprising:

a chassis;

printing components housed in the chassis, said printing components having an input path;

a tray positioned in the input path of the printing components, the tray being hingedly movable between a closed position and an open position, and the closed position prevents media from being inputted through the input path and the open position enables media to be inputted through the input path;

a strap connected to the tray;

a spring having a first end removably supported by the chassis and a second end removably supported by the strap;

a curved guide element attached to the chassis, the spring being to bend around a portion of the curved guide element as the tray is moved from the closed position to the open position;

a stop tab disposed on a wall of the chassis, the wall defining an opening through which the strap extends, and a notch of the strap that is to contact to the stop tab, wherein the spring and the curved guide element are to apply a force onto the strap to facilitate contact between the notch and the stop tab when the strap is in the second position.

9. The printing apparatus according to claim 8, further comprising a label positioned on the chassis at a location at which the spring is to contact the chassis, wherein the label has a lower coefficient of friction than the chassis.

10. The printing apparatus according to claim 8, wherein the spring, the curved guide element and the strap are collinear with respect to each other.

11. An apparatus comprising:

a wall;

a hinged tray;

a strap connected to the hinged tray;

a spring having a first end removably hooked onto the wall and a second end removably hooked onto the strap; and a guide element attached to the wall, the spring being to curve around a portion of the guide element as the strap is moved from a first position to a second position, wherein the first position corresponds to the hinged tray being at a first angle and the second position corresponds to the hinged tray being at a second angle, and wherein the spring is to dampen movement of the hinged tray from the first angle to the second angle, and wherein the hinged tray is supported in the second angle solely by the strap and the spring.

12. The apparatus according to claim 11, wherein the spring has a spring constant that enables the hinged tray to be moved from the first angle to the second angle at a specified rate.

* * * * *